US005108867A

United States Patent [19]

Wing, Jr. et al.

[11] Patent Number: 5,108,867

[45] Date of Patent: Apr. 28, 1992

[54] ELECTROSTATIC SYSTEM FOR MULTICOLOR IMAGING USING MICROCAPSULAR PHOTOSENSITIVE TONER PARTICLES DEPOSITED ON IMAGEWISE CHARGED TRANSFER SURFACE

[75] Inventors: Feagin A. Wing, Jr., Farmington, Conn.; Roger W. Day, Louisville, Ky.; Paul V. Grosso, West Hartford, Conn.; John C. Herbaugh, Maywood, N.J.

[73] Assignee: Olin Corporation, Cheshire, Conn.

[21] Appl. No.: 408,151

[22] Filed: Sep. 15, 1989

Related U.S. Application Data

[63] Continuation-in-part of Ser. No. 171,614, Mar. 23, 1988, Pat. No. 4,869,981, which is a continuation-in-part of Ser. No. 308,713, Feb. 10, 1989, Pat. No. 4,908,301.

[51] Int. Cl.[5] ..... G03G 9/093

[52] U.S. Cl. ..... 430/138; 430/45

[58] Field of Search ..... 430/45, 42, 46, 47, 430/138

[56] References Cited

U.S. PATENT DOCUMENTS

| | | | |
|---|---|---|---|
| 4,551,407 | 11/1985 | Sanders et al. | 430/138 |
| 4,554,235 | 11/1985 | Adair et al. | 430/138 |
| 4,801,949 | 1/1989 | Misono et al. | 346/76 |
| 4,906,301 | 3/1990 | Grosso et al. | 430/138 |
| 4,912,012 | 3/1990 | Hatta et al. | 430/138 |

FOREIGN PATENT DOCUMENTS 2113860 8/1983 United Kingdom .

*Primary Examiner*—John Goodrow
*Attorney, Agent, or Firm*—Ralph D'Alessandro

[57] ABSTRACT

An electrostatic multicolor imaging system employs a transfer surface which is charged imagewise such that blended microcapsular chromogenic photohardenable toner particles are electrostatically deposited only in those charged regions of a latent image formed on the surface where colors are to be provided for the image.

63 Claims, 4 Drawing Sheets

ELECTROSTATIC SYSTEM FOR MULTICOLOR IMAGING USING MICROCAPSULAR PHOTOSENSITIVE TONER PARTICLES DEPOSITED ON IMAGEWISE CHARGED TRANSFER SURFACE

CROSS REFERENCE TO RELATED APPLICATION

This application is a continuation-in-part of copending U.S. applications Ser. No. 171,614, entitled "Electrostatic Method For Multicolor Imaging From A Single Toner Bath", filed Mar. 23, 1988, now U.S. Pat. No. 4,869,981 and Ser. No. 308,713, entitled "Color Self-Developing Microcapsular Toner Particles", filed Feb. 10, 1989, now U.S. Pat. No. 4,908,301 both assigned to the same assignee as the present invention and specifically incorporated herein by reference in pertinent part.

BACKGROUND OF THE INVENTION

1. Field of the Invention

The present invention generally relates to electrostatic imaging systems and, more particularly, is concerned with an electrostatic system for multicolor imaging using microcapsular photosensitive toner particles deposited on an imagewise charged transfer surface.

2. Description of the Prior Art

One prior art imaging system disclosed in U.S. Pat. Nos. 4,399,209 and 4,440,846 and U.K. Pat. No. 2,113,860 assigned to Mead Corporation employs a paper or film web which is uniformly coated with photosensitive, chromogenic microcapsules. First, the uniformly coated web is imagewise exposed to actinic radiation and, then, the capsules are ruptured by pressure to contact their chromogenic contents with a developer, usually carried on a separate support, to produce a color image. A major disadvantage of this approach is that a precoated web of paper or film must be provided. This requirement creates problems in storage and handling of the precoated web and susceptibility of its capsules to breakage which results in unwanted background in the image.

Another prior art imaging system disclosed in U.S. Pat. No. 4,801,949 assigned to Seiko Instruments Inc. employs a container which separately stores the microcapsules prior to use and permits use of plain paper. The microcapsules are electrostatically drawn from the container and coated evenly or uniformly on the surface of an imaging body, such as on a photoreceptive drum or belt. Thereafter, a desired image is optically produced on the uniform layer of microcapsules by exposure to light in the pattern of the image on the evenly coated surface of the imaging body. However, as in the above-described prior art imaging system employing an uniformly precoated web, uniform electrostatic coating of the imaging body wastes a substantial amount of the chromogenic particles, especially when reproducing text material interspersed with some inset areas of color where the coverage of the image on the page may amount to no more than 10 to 20 percent of the page. This results in a high cost per page.

Consequently, a need still exists for an imaging system which will avoid the drawbacks of the above-described prior art system.

SUMMARY OF THE INVENTION

The present invention provides an electrostatic system designed to satisfy the aforementioned needs. In the electrostatic multicolor imaging system of the present invention, microcapsular photosensitive blended toner particles are only deposited on imagewise charged regions of a transfer surface. In other words, the multicolor imaging system employs a movable substrate having a photoconductive transfer surface that is charged imagewise such that blended chromogenic photosensitive, or photohardenable, toner particles will electrostatically deposit on the photoconductive transfer surface only in those charged regions of a latent image formed on the transfer surface corresponding to where color will be required or in uncharged regions when reversal development is used. A substantial amount of the chromogenic particles is thus saved compared to prior art systems. This results in a lower cost per image.

Further, the blended toner particles may be stored in a bottle and easily added to the apparatus as needed. The use of plain paper sheets, instead of a specially coated web, for the imaging substrate also results in further cost savings. Also, two, three, four or more kinds of color-producing toner particles may be deposited during one pass of the electrophotographic transfer surface, resulting in perfect registration of the several colors produced in the final image without use of mechanical registration steps being required.

Accordingly, the present invention is directed to an electrostatic multicolor imaging system which comprises: (a) a movable substrate having a charge accepting surface thereon; (b) means for charging selected regions of the surface to form a latent image thereon; (c) means for electrostatically depositing only on those regions of the surface having the latent image formed thereon a blend of microcapsular photosensitive chromogenic toner particles containing separately at least two different releasable color precursors which form the toned image; (d) means for photoselectively exposing the toner particles by irradiating the particles with selected quantities and patterns of light of wavelengths corresponding to different precursors to harden the toner particles in a pattern that corresponds to a desired pattern of colors for the toned latent image formed on the surface; (e) optionally means for supplying a support sheet; (f) optionally means for transferring the toned latent image of blended toner particles from the charge accepting surface to an image surface; and (g) means for color developing the unhardened blend of toner particles in the toned latent image thereof to produce the desired color image thereon. Further, the toner particle color developing means includes means for applying pressure to the transferred photoselectively exposed blend of toner particles on the image surface to release the color precursors from the unhardened toner particles in the desired pattern in the toned latent image Means for contacting this desired pattern of released color precursors on the image surface with a color developer are also provided to thereby cause the released color precursors and the color developer to react and form a developed color image.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
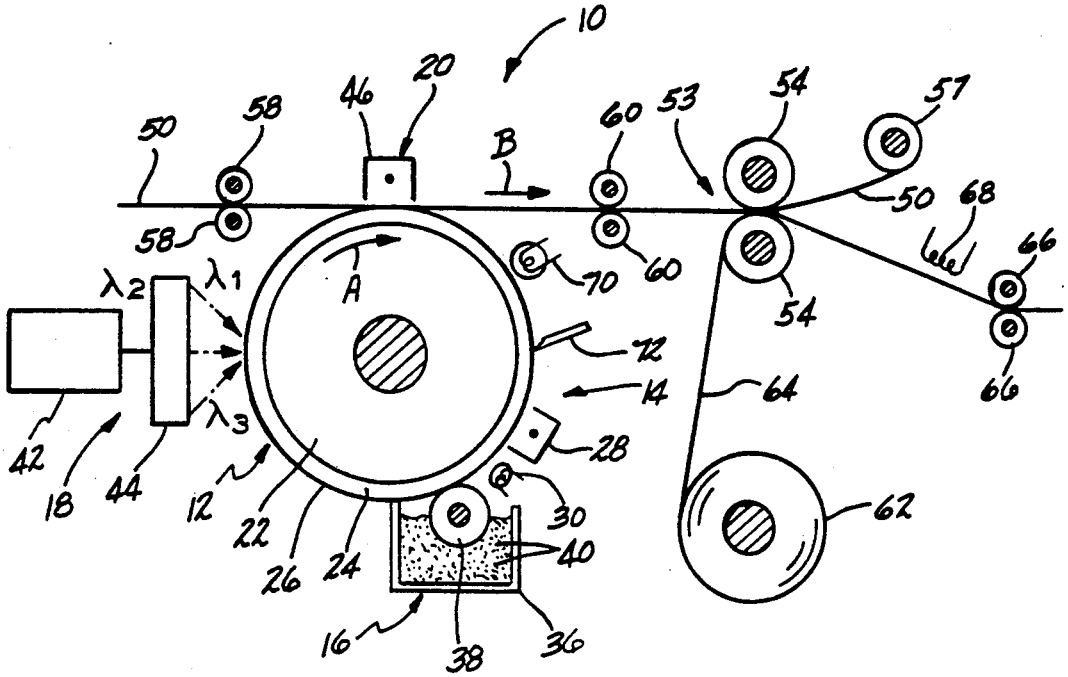
FIG. 1 is a diagrammatic view of an electrostatic multicolor imaging system in accordance with the present invention.

Referring now to the drawings, and particularly to FIG. 1, there is illustrated one embodiment of an electrostatic multicolor imaging system, generally designated 10, which operates in accordance with the principles of the present invention. For production of multicolor images, the imaging system 10 can employ different microcapsular photosensitive toner particles containing different color precursors as well as the electrostatic multicolor imaging method disclosed in the U.S. application cross-referenced above, the disclosure of which is incorporated by reference.

In the embodiment illustrated in FIG. 1, the multicolor imaging system 10 includes a movable substrate 12, a latent image forming means 14, an electrostatic depositing means 16, a light irradiating means 18, and a toned image transferring means 20. The movable substrate 12 of the system 10 is a drum 22 having an outer circumferential layer 24 coated with a photoconductive film providing a transfer surface 26 thereon. The drum 22 is connected to a suitable driving source (not shown) for rotating the drum 22 clockwise in the direction of the arrow A.

The latent image forming means 14 of the system 10 includes a first electrostatic charging device 28 and an imagewise light source 30 both of which are disposed adjacent to the drum 22 with the light source 30 downstream from the charging device 28 in the direction of drum rotation. The first charging device 28 is operable for uniformly supplying charge to the layer 24 of the drum 22. An imaging mask 32 for defining a latent image to be reproduced by the system 10 is disposed either between the light source 30 and the drum 22 (FIG. 1) or between the light source 30 and a mirror 34 (FIGS. 4A–4E) for correspondingly either directly or reflectively exposing the layer 24 to light from the light source 30. Such exposure of the layer 24 to light imaged by the mask 32 causes imagewise discharge of the layer 24.

The electrostatic depositing means 16 of the system 10 includes a toner supply bath or reservoir 36 disposed adjacent the dielectric drum 22 and downstream from the latent imaging forming light source 30 in the direction of drum rotation. An immersion roller 38 is mounted across the top of the reservoir 36. The roller 38 contacts both the dielectric layer 24 of the drum 22 and a blend of different microcapsular photosensitive toner particles 40 carried by a liquid contained in the reservoir 36. The blended toner particles 40 separately contain different releasable color precursors, such as cyan, magenta and yellow. The roller 38 is operable for electrostatically depositing the blended toner particles 40 only on those regions of the transfer surface 26 of the drum layer 24 having the latent image formed thereon.

The light irradiating means 18 of the system 10 includes an optical control circuit 42 and an optical modulator 44 disposed adjacent to the drum 22 and downstream from the toner supply reservior 36 in the direction of drum rotation. The optical modulator 44 is operable in response to image signals from the optical control circuit 42 for exposing the deposited toner particles 40 with selected quantities and patterns of beams of light having wavelengths identified as lambda 2 and 3 in FIG. 1. These wavelengths of light correspond to the different color precursors. Such exposure of the particles results in the photohardening of some and not others to provide a photohardened pattern of particles that corresponds to the desired pattern in the toned latent image formed on the transfer surface 26.

The toned latent image transferring means 20 of the system 10 is a second electrostatic charging device 46 disposed adjacent to the drum 22 downstream from the optical modulator 44 in the direction of drum rotation. The second charging device 46 is operable for transferring the toned latent image formed by the blend of photohardened and unhardened toner particles 40 from the transfer surface 26 to a toned image surface 48 of a support web or sheet 50, as seen in FIGS. 4(*f*) and 4(*g*). The charge-accepting surface upon which the latent image is formed can be either a photoconductive surface where blanket charging, with subsequent selective discharge, or a dielectric surface where only selective charging occurs. The surface upon which the toner particles are electrostatically deposited to form the toned image can be either the final receiving surface, in the case of a coated photoconductive substrate, such as a zinc oxide coated paper, or a direct transfer surface, such as a photoconductive or dielectric surface from which the toned image is transferred to a final receiving surface that is a precoated color developer precoated substrate, or an in-situ color developer-coated surface, or a final receiving surface where color self-developing toner particles having the color developer carried with the color toner particles are used.

In another embodiment the toned image can be formed on the charge accepting surface, transferred to an intermediate transfer surface, and then transferred a second time to the final receiving surface. In this latter case, the color toner particles can be color developed on either the intermediate transfer surface or the final receiving surface.

In the embodiment illustrated in FIG. 1, the imaging system 10 is designed for a double transfer of the toned image first to the intermediate support sheet 50 and then to a final receiving surface 64. Imaging system 10 includes a support sheet supplying means (not shown), a support sheet take-up means 57, a color developing means 53 and a pressure applying and transfer means 54. The support sheet supplying means of the system 10 can supply the support sheet 50 as ordinary paper or suitable synthetic films, such as polyester in separate sheets or in a continuous web from a roll. The supplying means also includes a pair of guide rollers 58 and 60 located respectively upstream and downstream of the second charging device 46. The guide rollers 58 and 60 are operable for moving the support sheet 50 between the second charging device 46 and drum 22, in the direction of arrow B tangential to, and at the same speed as the rotational speed of, the drum outer layer 24. As the sheet 50 moves past the drum outer layer 24, as mentioned above, the second charging device 46 electrostatically transfers the toned latent image formed by the blend of hardened and unhardened toner particles 40 from the transfer surface 26 to the sheet 50.

The pressure applying means 54 of the developing means 53 is a pair of pressure rollers located downstream from the guide rollers 60 in the direction of support sheet travel. The pressure rollers 54 apply sufficient pressure to rupture the unhardened ones of the photosensitive toner particles 40 to release the color precursors therefrom in the desired pattern of colors on the toned image receiving surface 48. The color developing means 53 includes a supply roll 62 which has a web or sheet 64 on which a developing substance is applied. The copy surface 64 of FIG. 4(*f*) passes between the pressure rollers 54 in contact with the imaging support sheet 50 such that the color precursors released by rupturing of the unhardened toner particles react with color developer and form the desired color image on the copy surface 64.

Another pair of guide rollers 66 of the system 10 of FIG. 1 route the combined image support sheet 50 and copy or image surface 64 of FIG. 4(*f*) to a take-up reel (not shown). The copy or image surface 64 is heated by a heating element 68, since heat accelerates the reaction between the color precursors released by the particles and the developer on the copy surface 64. The colors are thus generated in accordance with the image signals and a color pattern is reproduced in accordance with the input image signals.

The imaging system 10 of FIG. 1 further includes an eraser lamp 70 and a cleaning device 72 disposed adjacent the drum 22 between the first and second charging devices 28 and 46. The electrostatic attraction force on the transfer surface 26 of the outer dielectric drum layer 24 is eliminated by operation of the eraser lamp 70. Any microcapsular particles remaining on the drum transfer surface 26 are removed by the cleaning device 72 to prepare for the next printing cycle.

Figure 2:
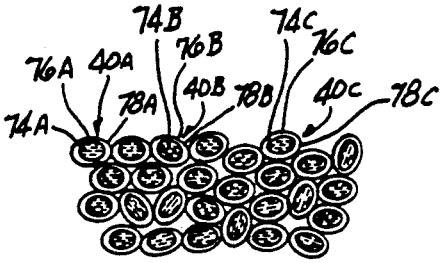
FIG. 2 is a diagrammatic cross-sectional view photosensitive microcapsular chromogenic toner particles used in the imaging system of the present invention.
Figure 3:
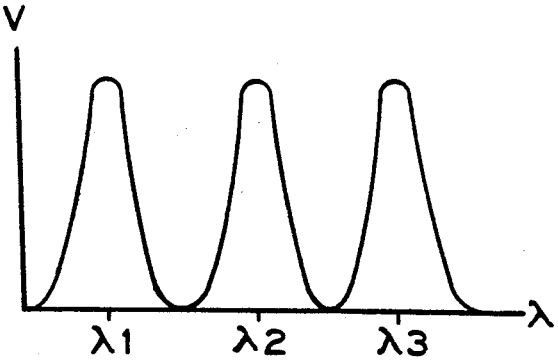
FIG. 3 is a graph of the spectral regions to which the microcapsular toner particles of FIG. 2 are sensitive.

Referring to FIG. 2, there is diagrammatically illustrated a blend of three different photosensitive microcapsular chromogenic toner particles 40A, 40B, 40C that are deposited on the transfer surface 26 (not shown) of the layer 24. The particles contain the precursors of the colors of cyan, magenta and yellow respectively. Chromogenic materials 74A, 74B, 74C that generate cyan, magenta and yellow, respectively, and photosensitive compositions 76A, 76B, 76C are together microencapsulated by thin outer films 78A, 78B, 78C made of, for example, gelatin which surround them. The photosensitive compositions 76A, 76B, 76C immobilize the chromogenic materials by changing viscosity as a result of exposure to electromagnetic light beams of wavelengths lambda 1, 2, 3 that correspond to the colors of the chromogenic materials. FIG. 3 depicts graphically the spectral regions of the wavelengths lambda 1, 2, 3 to which the microcapsular toner particles 40 of FIG. 1 and diagrammatically illustrated in FIG. 2 are sensitive.

The toner particles 40 are coated in this manner on the transfer surface 26 of the dielectric layer 24 only where required by the characteristics of the image being reproduced. When the electrostatically deposited toner particles 40 are exposed to light having the wavelengths at which the photosensitive compositions 76A, 76B, 76C within the respective toner particles 40A, 40B, 40C react, the viscosity of the photosensitive compositions changes. After the toner particles, thus exposed, are imagewise transferred electrostatically to the support sheet 50 by action of the second charging device 46, they are ruptured upon passage between the pressure rollers 54. As a result, those toner particles exposed to light release less chromogenic material than those not thus exposed. Consequently, colors corresponding to the wavelengths lambda 1, 2, 3 of the exposing light are presented on the image-receiving sheet 64. In this way color patterns in accordance with the patterns presented at the time of light projection can be obtained.

Figure 4B:
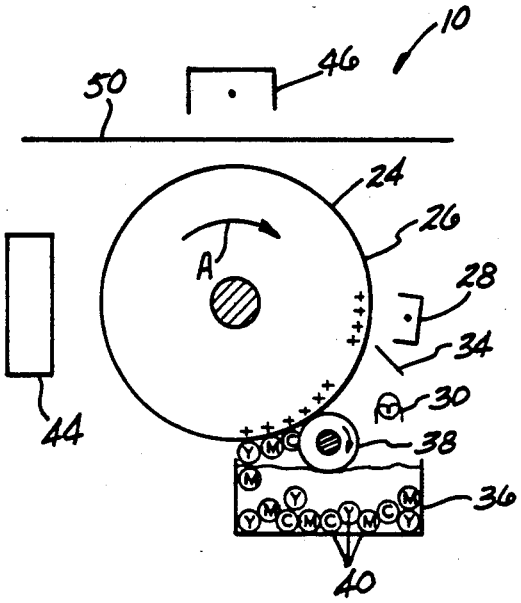
FIGS. 4A–4G are diagrammatic views of the imaging system of FIG. 1 at successive stages of its operation.
Figure 4A:
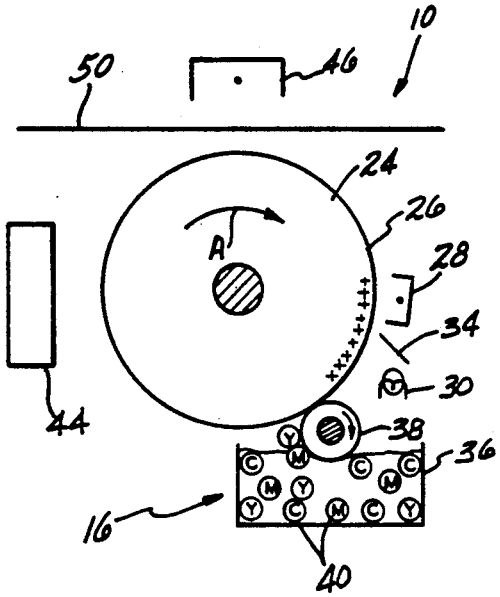

FIGS. 4A–4G are diagrammatic views of the imaging system of FIG. 1 at successive stages of its operation. FIG. 4A illustrates sequential charging of the layer 24 of the transfer surface 26 to a predetermined potential by the first charging device 28 and then imagewise dissipation of the charge in regions thereon by irradiation means 30. As an example, a light source directly or reflectively can irradiate the photoconductive transfer surface 26 in an imagewise positive or negative fashion as the drum 22 is rotated clockwise in the direction of arrow A.

FIG. 4B illustrates sequential application or deposition of toner particles 40 onto the transfer surface 26 by the immersion roller 38 at the toner supply reservoir 36 as the dielectric drum 22 continues clockwise rotation in the direction of arrow A. The toner particles 40 attached to the immersion roller 38, together with the liquid dispersing them, are adsorbed imagewise and electrostatically to the charged areas on the transfer surface 26.

Figure 4C:
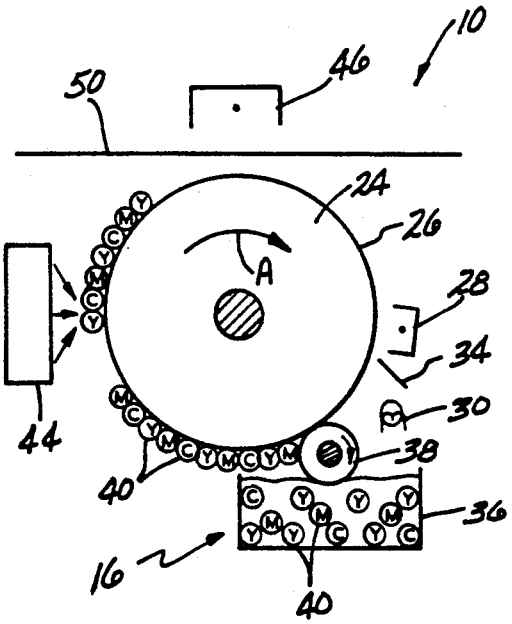

In FIG. 4C, the toner particles 40 thus imagewise adsorbed on the transfer surface 26 of the drum layer 24 are sequentially or simultaneously irradiated with light of appropriate wavelengths when image signals for obtaining a hard copy are outputted to the optical modulator 44. The optical modulator 44 scans an optical beam of each wavelength lambda 1, 2, 3 in the axial direction relative to and synchronously with the rotation of the dielectric drum 22 while controlling the optical intensity in response to the image signals. Accordingly, the toner particles 40 adsorbed imagewise on the transfer surface 26 of the dielectric layer 24 are photosensitive, some being photohardened relatively more than others, in response to the quanta of light irradiating them, forming a collection of unhardened and relatively hardened toner particles.

Figure 4D:
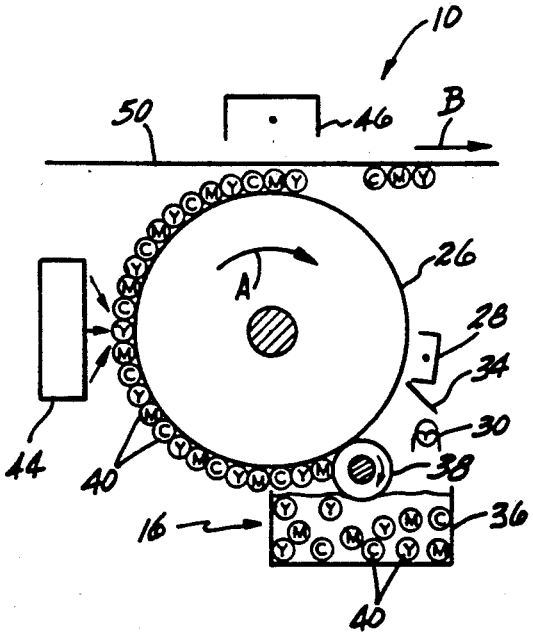
Figure 4F:
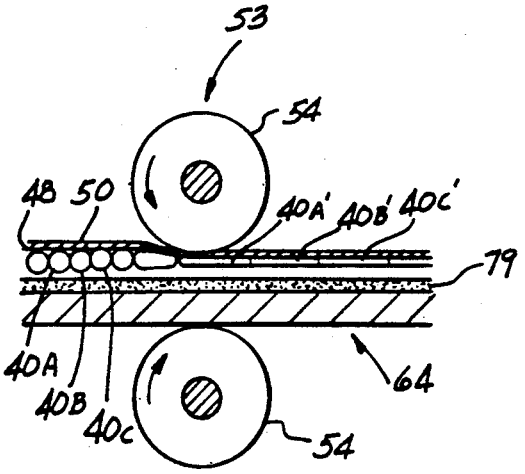
Figure 4E:
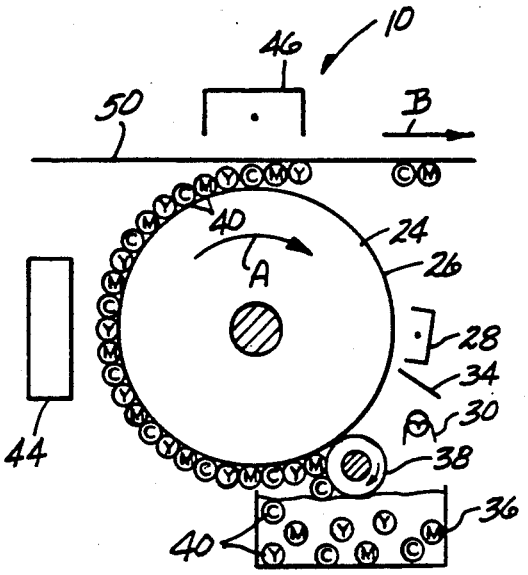

FIGS. 4D–4E illustrate sequential image-wise transfer of the photoselectively exposed and, therefore, hardened and unhardened toner particles 40 from the transfer surface 26 to the support sheet 50 by electrostatic attraction produced by the second charging device 46. The support sheet 50 moves in the direction B at the same speed as the rotation of the drum 22 in the direction A. Thereafter, the photoselectively exposed hardened or unhardened toner particles 40 are imagewise adsorbed on the support sheet 50.

Figure 4G:
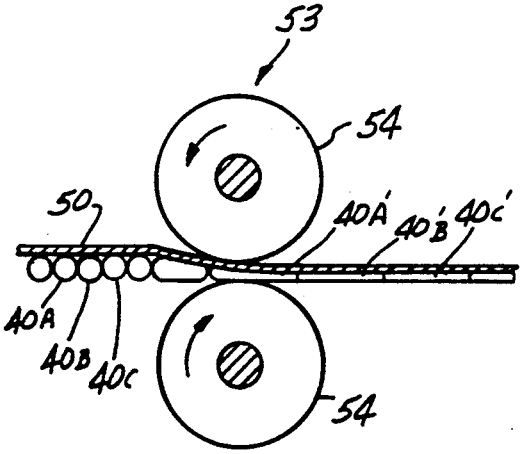

FIG. 4F illustrates the use of the intermediate and final transfer surfaces where the toner particles 40 on the support sheet 50, together with the copy or image surface 64 having color developer 79 thereon, are subjected to pressure by rollers 54. FIG. 4G represents an alternative where the intermediate transfer surface is not used. In this illustration the particles may be color self-developing toner particles, or the color developer may be applied to the final receiving surface 59 before or after toner particle transfer, or the final receiving surface 59 may be precoated with the color developer. At the stage viewed in FIG. 4F, each photosensitive composition 76A–76C on the support sheet 50 has been hardened or left unhardened in accordance with the light exposure quantity so that the amounts of the chromogenic materials 74A–74C flowing out of the toner particles 40A–40C are different from one another in response to the exposure quantity. Accordingly, the chromogenic materials 74A–74C release or soak out of the the relatively unhardened toner particles and react with a developer substance, either on the surface of the individual toner particles or on the surface of the copy surface 64, to produce color in amounts inversely corresponding to the exposure quantity. In FIGS. 4(*f*) and 4(*g*) 40A', 40B' and 40C' represent the ruptured color toner particles corresponding to particles 40A, 40B and 40C, but with the corresponding developed color in place on the image receiving surfaces 59 or 64.

Finally, in FIG. 1, the drum 22 that has delivered the toner particles 40 to the support sheet 50 is evenly irradiated with light from the eraser lamp 70 to eliminate residual electrostatic charge on its transfer surface 26. Any toner particles 40 remaining on the surface of the dielectric layer 24 are removed by the cleaning device 72 to prepare for the next printing cycle.

Figure 5:
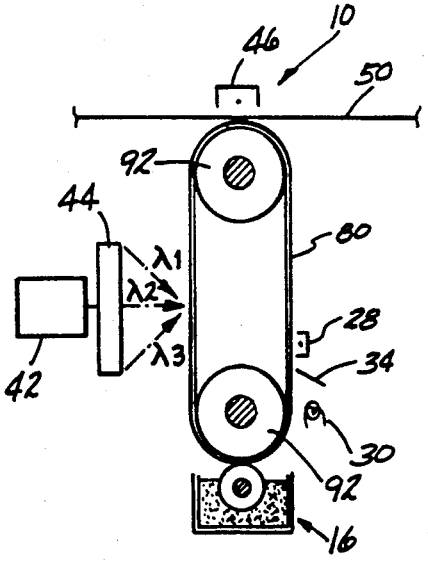
FIGS. 5 and 6 are diagrammatic views of other embodiments of the imaging system of the present invention.
Figure 7:
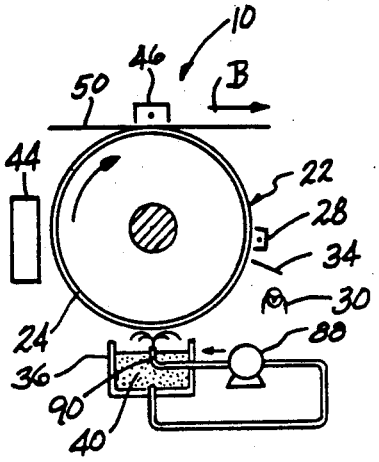
FIGS. 7, 8 and 9 are diagrammatic views of other embodiments of the toner particle supply which can be employed in the imaging system of the present invention.
Figure 6:
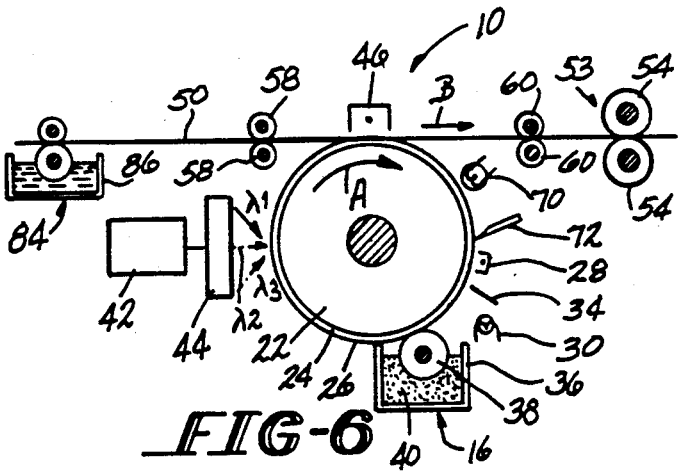
Figure 9:
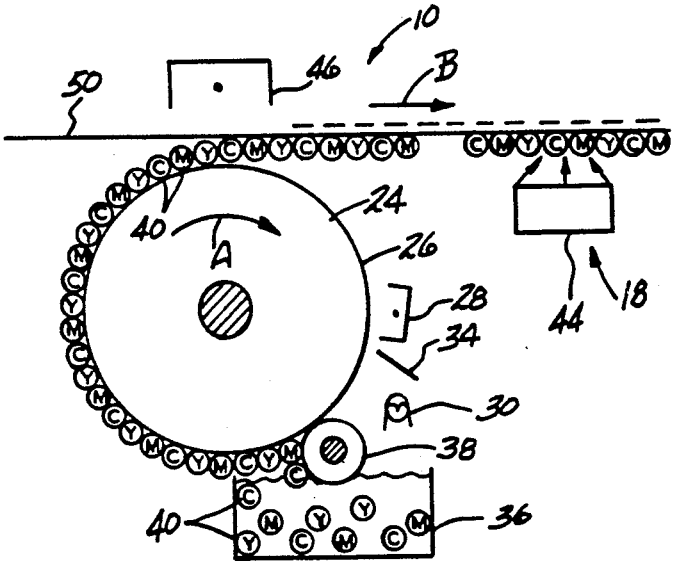
Figure 8:
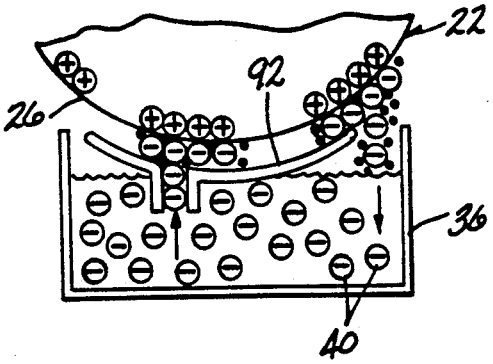

Certain modifications to the arrangement of the system in FIG. 1 are illustrated in FIGS. 5–9. FIG. 5 shows the use of a dielectric belt 80 entrained over a pair of spaced rollers 92 instead of the drum 22. FIG. 6 illustrates a developing solution coating device 84 disposed upstream of the drum 22 in the direction B of movement of the support sheet 50 for uniformly applying developing solution 86 to the support sheet 50, eliminating the need for the separate copy surface 64 and the problem of storing the same. Alternatively the developing solution coating device 84 could be positioned downstream or after the drum 22 and even possibly after the pressure applying and transfer means 54. FIGS. 7 and 8 show other devices for applying the toner particles to the dielectric layer 24. In FIG. 7, a pump 88 recirculates toner particles to supply a jet spray from a nozzle 90 which projects the particles against the rotating dielectric outer layer 24 of drum 22. FIG. 8 illustrates employment of a tray 92 through which the particles are circulated adjacent the transfer surface 26. In FIG. 9, the order of irradiating and hardening of the particles and transfer of the particles from the drum 22 to the support sheet 50 are reversed by placing the light irradiating means 18 downstream of the second charging device 46.

Figure 10:
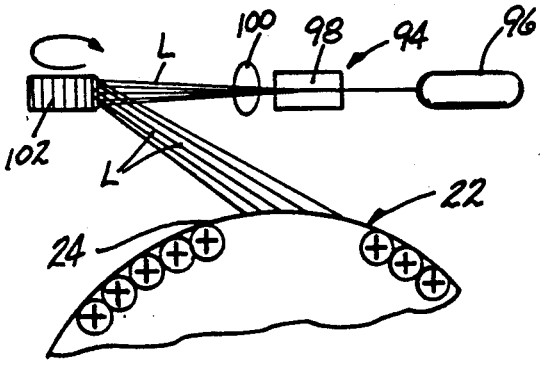
FIG. 10 is a diagrammatic view of an arrangement of components which can be used in the system of FIG. 1.

By way of example, FIG. 10 illustrates an arrangement 94 which can be used as the light source 30 for imagewise irradiating the dielectric transfer surface 26 for discharging selected regions thereof and as the optical modulator 44 for imagewise irradiating the particles after after they are adsorbed on the transfer surface. The arrangement 94 includes a laser 96 for projecting a beam L through an acousto-optic deflector 98 and mirror 100 and then reflecting the laser beam L onto the dielectric layer 24 via a rotating polygon mirror 102.

Also, by way of example, the first and second charging devices 28 and 46 can be corona charge transfer devices. The cleaning device 72 can be a rotating brush.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. An electrostatic multicolor imaging system, comprising:

(a) a movable substrate having a charge accepting transfer surface thereon;

(b) means for charging said charge accepting transfer surface as at least a first step to forming a latent image thereon;

(c) means for electrostatically depositing imagewise only on those regions of said charge accepting transfer surface having said latent image formed thereon a blend of microcapsular photosensitive toner particles containing separately at least two different releasable color precursors to form a toned image;

(d) means for irradiating said toner particles with selected quantities and patterns of light of wavelengths corresponding to the different precursors to photoharden a portion of said toner particles to form a pattern of unhardened and selectively photohardened toner particles that corresponds to a desired pattern for said toned image formed on said charge accepting transfer surface;

(e) means for movably supplying a support sheet;

(f) means for transferring said toned image of unhardened and photohardened toner particles from said charge accepting transfer surface to an imaging surface of said support sheet; and (g) developing means for producing color from said transferred toner particles in said toned image thereof on said support sheet to produce the desired pattern in the developed color image thereon.

2. The system of claim wherein said developing means includes:

means for applying pressure to said blend of photosensitive toner particles on said image surface to release said color precursors from said unhardened photosensitive particles in the desired pattern for said developed latent image; and means for developing color by contacting a color developer with said color precursors released from said unhardened photosensitive particles on said image surface to cause said released color precursors and said color developer to react and form the desired pattern in the developed color image on said image surface.

3. The system of claim 2 wherein said color developing means includes a coating device for applying a developing solution to said image surface.

4. The system of claim 2 wherein said color developing means includes a supply device and a toned image-receiving surface supported thereon, said surface having a color developer applied thereon, said supply device being operable for feeding said surface into contact with said moving image surface as pressure is applied to the latter by said pressure applying means.

5. The system of claim 1 wherein said latent image forming means includes:

an electrostatic charging device disposed adjacent said movable substrate and operable for uniformly supplying electrical charge to said charge accepting transfer surface; and means disposed adjacent said movable substrate and downstream from said charging device in the direction of substrate movement for discharging selected regions of said charge accepting transfer surface to produce a latent image thereon.

6. The system of claim 1 wherein said movable substrate is a rotatable drum having an outer layer coated with a photoconductive film which defines said charge accepting transfer surface thereon.

7. The system of claim 1 wherein said movable substrate is a movable belt having an outer layer coated with a photoconductive film which defines said charge accepting transfer surface thereon.

8. The system of claim 5 wherein said discharging means includes a light source for imagewise irradiating said charge accepting transfer surface to discharge said selected regions thereof.

9. The system of claim 8 wherein said light source is a laser.

10. The system of claim 7 wherein said charge accepting transfer surface is dielectric and said means for charging said dielectric charge accepting transfer surface selectively charges said surface.

11. The system of claim 1 wherein said toner particle depositing means includes:

a toner particle supply reservoir disposed adjacent said movable substrate and downstream from said latent imaging forming means in the direction of substrate movement; and means for contacting said blend of different toner particles with said charge accepting transfer surface.

12. The system of claim 11 wherein said contacting means is a suction roller mounted across a top of said reservoir and in contact with both said charge accepting transfer surface and said toner particles within said reservoir.

13. The system of claim 11 wherein said contacting means is a pump and a jet facing toward said substrate, said pump communicating with said reservoir and said jet and being operable to circulate toner particles to said jet, said jet being operable to project said particles against said charge accepting transfer surface.

14. The system of claim 11 wherein said contacting means is a tray mounted across a top of said reservoir and through which said particles are circulated into contact with said charge accepting transfer surface.

15. The system of claim 1 wherein said light irradiating means includes:

an optical control circuit for generating image signals; and an optical modulator disposed adjacent said substrate and downstream from said toner particle depositing means in the direction of substrate movement and being operable in response to image signals from said optical control circuit for exposing said toner particles to photoharden the same.

16. The system of claim 15 wherein said optical modulator includes a laser light source for imagewise irradiating said charge accepting transfer surface to photoharden said toner particles thereon.

17. The system of claim 1 wherein said toned image transferring means includes an electrostatic charging device disposed adjacent said substrate and downstream from said light irradiating means in the direction of substrate movement, said charging device being operable to transfer said toned image formed by said blend of photohardened and unhardened toner particles from said charge accepting transfer surface to said image sheet.

18. The system of claim 1 wherein the image surface on the support sheet is a final receiving surface.

19. The system of claim wherein the image surface on the support sheet is an intermediate transfer surface from which the toned latent image is transferred to a final receiving surface.

20. The system of claim 4 wherein the image surface is a direct transfer surface.

21. An electrostatic multicolor imaging system, comprising:

(a) a movable substrate having a charge accepting transfer surface thereon;

(b) means for charging said charge accepting transfer surface as at least a first step to forming a latent image thereon;

(c) means for electrostatically depositing imagewise only on those regions of said charge accepting transfer surface having said latent image formed thereon a blend of microcapsular photosensitive toner particles containing separately at least two different releasable color precursors to form a toned image;

(d) means for movably supplying a support sheet;

(e) means for transferring said imagewise deposited toner particles from said charge accepting transfer surface to an image surface of said support sheet;

(f) means for irradiating said transferred toner particles with selected quantities and patterns of light of wavelengths corresponding to the different precursors to selectively photoharden a portion of said particles to form a pattern of unhardened and selectively photohardened toner particles that corresponds to a desired pattern for said toned image; and (g) means for developing said blend of toner particles in said toned image thereof on said support sheet to produce the desired pattern in the developed color image thereon.

22. The system of claim 21 wherein said developing means includes:

means for applying pressure to said blend of photosensitive toner particles on said image surface to release said color precursors from said unhardened photosensitive particles in the desired pattern of colors for said latent image; and means for developing color by contacting a color developer with said color precursors released from said unhardened photosensitive particles on said image surface to cause said released color precursors and said color developer to react and form the desired pattern in the developed color image on said image surface.

23. The system of claim 22 wherein said color developing means includes a coating device for applying a developing solution to said image surface.

24. The system of claim 22 wherein said color developing means includes a supply device and a toned image-receiving surface supported thereon, said surface having a color developer applied thereon, said supply device being operable for feeding said surface into contact with said image surface as pressure is applied to the latter by said pressure applying means.

25. The system of claim 21 wherein said movable substrate is a rotatable drum having an outer layer coated with a photoconductive film which defines said charge accepting transfer surface thereon.

26. The system of claim 21 wherein said movable substrate is a movable belt having an outer layer coated with a photoconductive film which defines said charge accepting transfer surface thereon.

27. The system of claim 21 wherein said means for charging to form a latent image includes:

an electrostatic charging device disposed adjacent said movable substrate and operable for uniformly supplying electrical charge to said charge accepting transfer surface; and means disposed adjacent said movable substrate and downstream from said charging device in the direction of substrate movement for discharging selected regions of said charge accepting transfer surface to produce a latent image thereon.

28. The system of claim 27 wherein said discharging means includes a light source for imagewise irradiating said charge accepting transfer surface to discharge said selected regions thereof.

29. The system of claim 28 wherein said light source is a laser.

30. The system of claim 27 wherein said charge accepting transfer surface is dielectric and said means for charging said dielectric charge accepting transfer surface selectively charges said surface.

31. The system of claim 21 wherein said toner particle depositing means includes:

a toner particle supply reservoir disposed adjacent said movable substrate and downstream from said latent imaging forming means in the direction of substrate movement; and means for contacting said blend of different toner particles with said substrate transfer surface.

32. The system of claim 31 wherein said contacting means is a suction roller mounted across a top of said reservoir and in contact with both said charge accepting transfer surface and said toner particles within said reservoir.

33. The system of claim 31 wherein said contacting means is a pump having a jet facing toward said substrate and provided in communication with said reservoir, said pump being operable to recirculate toner particles to said jet thereof and said jet being operable to project said particles against said charge accepting transfer surface.

34. The system of claim 31 wherein said contacting means is a tray mounted across a top of said reservoir through which said particles are circulated into contact with said substrate transfer surface.

35. The system of claim 21 wherein said latent image transferring means includes an electrostatic charging device disposed adjacent said movable substrate and downstream from said toner particle depositing means in the direction of substrate movement, said charging device being operable to transfer said toned image formed by said blend of toner particles from said charge accepting transfer surface to said imaging sheet.

36. The system of claim 21 wherein said light irradiating means includes:

an optical control circuit for generating image signals; and an optical modulator disposed adjacent said support sheet and downstream from said image transferring means in the direction of support sheet movement and being operable in response to image signals from said optical control circuit for photoselectively exposing said toner particles to photoharden the same.

37. The system of claim 36 wherein said optical modulator includes a laser light source for imagewise irradiating said support sheet to photoharden said toner particles.

38. The system of claim 21 wherein said support sheet is a final receiving surface.

39. The system of claim 21 wherein the image surface on the support sheet is an intermediate transfer surface from which the toned latent image is transferred to a final receiving surface.

40. The system of claim 24 wherein the image surface is a direct transfer surface.

41. An electrostatic multicolor imaging system, comprising:

(a) a movable substrate having a charge accepting transfer surface thereon;

(b) means for charging said charge accepting transfer surface as at least a first step to forming a latent image thereon;

(c) means for electrostatically depositing imagewise only on those regions of said charge accepting transfer surface having said latent image formed thereon a blend of microcapsular photosensitive toner particles containing separately at least two different releasable color precursors to form a toned image;

(d) means for irradiating said toner particles with selected quantities and patterns of light of wavelengths corresponding to the different precursors to selectively photoharden a portion of said particles to form a pattern of unhardened and selectively photohardened toner particles that corresponds to a desired pattern for said toned image on said charge accepting transfer surface;

(e) color developing means for producing color from said blend of toner particles in said toned image to release said color precursors on said charge accepting transfer surface; and (f) means for transferring at least said released color precursors from said charge accepting transfer surface to a receiving surface.

42. The system of claim 41 wherein said developing means includes:

means for applying pressure to said blend of unhardened and selectively photohardened toner particles on said charge accepting surface to release said color precursors from said unhardened toner particles in the desired pattern of colors for said latent image; and means for developing color by contacting a color developer with said color precursors released from said unhardened photosensitive particles on said charge accepting surface to cause said released color precursors and said color developer to react and form the desired pattern in the developed color image.

43. The system of claim 42 wherein said color developing means includes a coating device for applying a color developer to said receiving surface to contact said released and transferred color precursors to cause said released color precursors and said color developer to react and form the desired pattern in the developed color image.

44. The system of claim 42 wherein said means for transferring said developed color image includes a supply device to feed the receiving surface adjacent to the charge accepting transfer surface.

45. The system of claim 41 wherein said movable substrate is a rotatable drum having an outer layer coated with a photoconductive film which defines said charge accepting transfer surface thereon.

46. The system of claim 41 wherein said movable substrate is a movable belt having an outer layer coated with a photoconductive film which defines said charge accepting transfer surface thereon.

47. The system of claim 41 wherein said means for charging to form a latent image includes:

an electrostatic charging device disposed adjacent said movable substrate and operable for uniformly supplying electrical charge to said charge accepting transfer surface; and means disposed adjacent said movable substrate and downstream from said charging device in the direction of substrate movement for discharging selected regions of said charge accepting transfer surface to produce a latent image thereon.

48. The system of claim 47 wherein said discharging means includes a light source for imagewise irradiating said charge accepting transfer surface to discharge said selected regions thereof.

49. The system of claim 48 wherein said light source is a laser.

50. The system of claim 47 wherein said charge accepting transfer surface is dielectric and said means for charging said dielectric charge accepting transfer surface selectively charges said surface.

51. The system of claim 41 wherein said toner particle depositing means includes:

a toner particle supply reservoir disposed adjacent said movable substrate and downstream from said latent image forming means in the direction of substrate movement; and means for contacting said blend of different toner particles with said charge accepting transfer surface.

52. The system of claim 41 wherein said light irradiating means includes:

an optical control circuit for generating image signals; and an optical modulator disposed adjacent said supply device and downstream from said image transferring means in the direction of receiving surface movement and being operable in response to image signals from said optical control circuit for photoselectively exposing said toner particles to photoharden the same.

53. The system of claim 52 wherein said optical modulator includes a laser light source for imagewise irradiating said transfer surface to photoharden said toner particles.

54. The system of claim 41 wherein said receiving surface is a final receiving surface.

55. The system of claim 41 wherein the receiving surface is an intermediate transfer surface from which the developed color image is transferred to a final receiving surface.

56. The system of claim 44 wherein the receiving surface is a direct transfer surface.

57. The system of claim 41 wherein said contacting means is a suction roller mounted across a top of said reservoir and in contact with both said charge accepting transfer surface and said toner particles within said reservoir.

58. The system of claim 41 wherein said contacting means is a pump having a jet facing toward said substrate and provided in communication with said reservoir, said pump being operable to recirculate toner particles to said jet thereof and said jet being operable to project said particles against said charge accepting transfer surface.

59. The system of claim 41 wherein said contacting means is a tray mounted across a top of said reservoir through which said particles are circulated into contact with said substrate transfer surface.

60. The system of claim 41 wherein the color developing means further releases the contents from said unhardened toner particles.

61. The system of claim 41 wherein said toner particles are color self-developing.

62. The system of claim 1 wherein said toner particles are color self-developing.

63. The system of claim 21 wherein said toner particles are color self-developing.

* * * * *